United States Patent [19]

Joslin

[11] Patent Number: 4,991,313

[45] Date of Patent: Feb. 12, 1991

[54] GRADUAL HEAT REDUCTION FOR A CLOTHES DRYER

[75] Inventor: Dan F. Joslin, Fort Dodge, Iowa

[73] Assignee: White Consolidated Industries, Inc., Webster City, Iowa

[21] Appl. No.: 467,921

[22] Filed: Jan. 22, 1990

[51] Int. Cl.[5] ..... F26B 21/06; F26B 19/00

[52] U.S. Cl. ..... 34/48; 34/46

[58] Field of Search ..... 34/48, 46, 26, 22, 20, 34/30, 43

[56] References Cited

U.S. PATENT DOCUMENTS

| | | | |
|---|---|---|---|
| 4,086,707 | 5/1978 | Bochan | 34/48 |
| 4,209,915 | 7/1980 | Keuleman et al. | 34/48 |
| 4,231,166 | 11/1980 | McMillan | 34/48 |
| 4,397,101 | 8/1983 | Rickard | 34/48 |
| 4,439,931 | 4/1984 | Mizuta | 34/48 |
| 4,531,305 | 7/1985 | Nagayasu et al. | 34/48 |

*Primary Examiner*—Henry A. Bennett
*Assistant Examiner*—Denise L. F. Gromoda
*Attorney, Agent, or Firm*—Pearne, Gordon, McCoy & Granger

[57] ABSTRACT

A method and apparatus is disclosed for the gradual reduction of heat in a clothes dryer. The heater runs until a high limit is reached. The heater is then turned off and the high limit reduced by a factor. The heater is turned on when a low limit is reached and the low limit is reduced by a factor. This continues until the high and low limits reach minimum values. The values of all these temperatures may be varied according to the fabric being dried.

6 Claims, 2 Drawing Sheets

GRADUAL HEAT REDUCTION FOR A CLOTHES DRYER

BACKGROUND OF THE INVENTION

The present invention relates to a method and apparatus for drying articles in a clothes dryer.

The temperature of the load of clothes or other articles in a clothes dryer is an important measure of dryer performance. In general, the higher the load temperature, the shorter the drying time. However, high load temperatures result in less satisfactory results (e.g. wrinkled permanent-press).

SUMMARY OF THE INVENTION

The gradual heat reduction of the present invention reduces the load temperature without increasing the drying time by a proportional amount.

This method comprises measuring the exhaust temperature. The heater is deactivated if the measurement is greater than a high limit and the high limit is reduced by a high limit reduction factor but not to less than a minimum high limit. The heater is activated if the exhaust temperature is less than a low limit and the low limit is reduced by a low limit reduction factor but not to less than a minimum low limit.

In the preferred embodiment, the high limit reduction factor and low limit reduction factor are equal.

A plurality of sets of values for the high limit, high limit reduction factor, minimum high limit, low limit, low limit reduction factor, and minimum low limit may be provided, each being adapted to a particular fabric.

In this way the optimum gradual heat reduction regime may be provided for each type of fabric.

An apparatus for gradual heat reduction in a clothes dryer is provided by means to perform the above steps.

DESCRIPTION OF THE PREFERRED EMBODIMENTS

Figure 1:
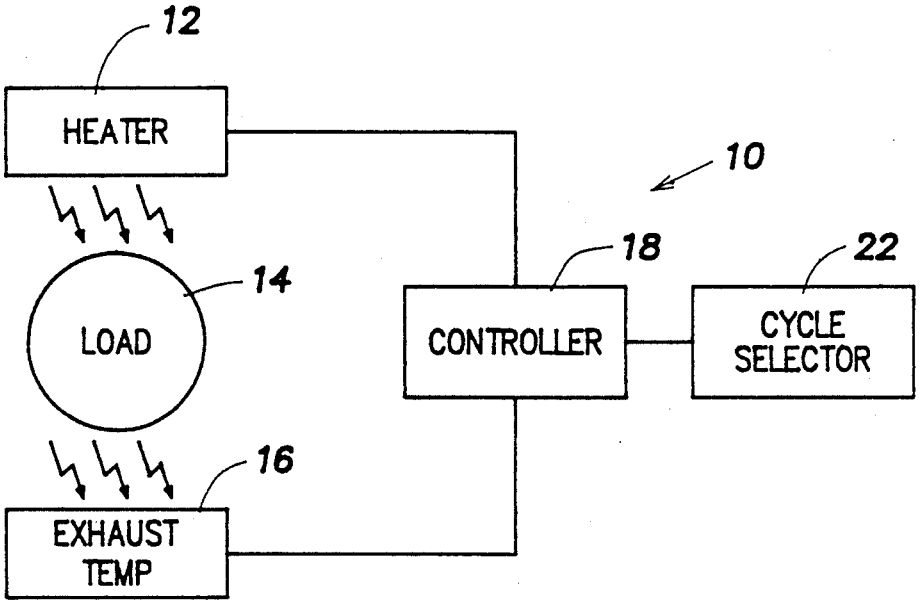
FIG. 1 is a schematic diagram of clothes dryer according to the invention.

A clothes dryer 10 according to the invention is shown in FIG. 1. A heater 12 provides heated air to a load 14 of clothes or other articles. The heater 12 may be, for example, of the resistive electric type of the combustion type.

After moving about the load 14, the air is exhausted from the dryer 10. The temperature 16 may measured, for example, by a thermistor or a resistor with a known temperature/resistance characteristic.

The temperature 16 of the exhausted air is provided to a controller 18. In the preferred embodiment, the controller 18 comprises a microprocessor which is programmed to perform the method described below. The controller 18 also includes the necessary support circuitry to activate and deactivate the heater 12 and to monitor the temperature 16.

The cycle selector 22 provides an input to the controller 18 to select between sets of values stored in the controller 18 for different fabrics. The cycle selector 22 may be, for example, a rotary selector switch.

Figure 2:
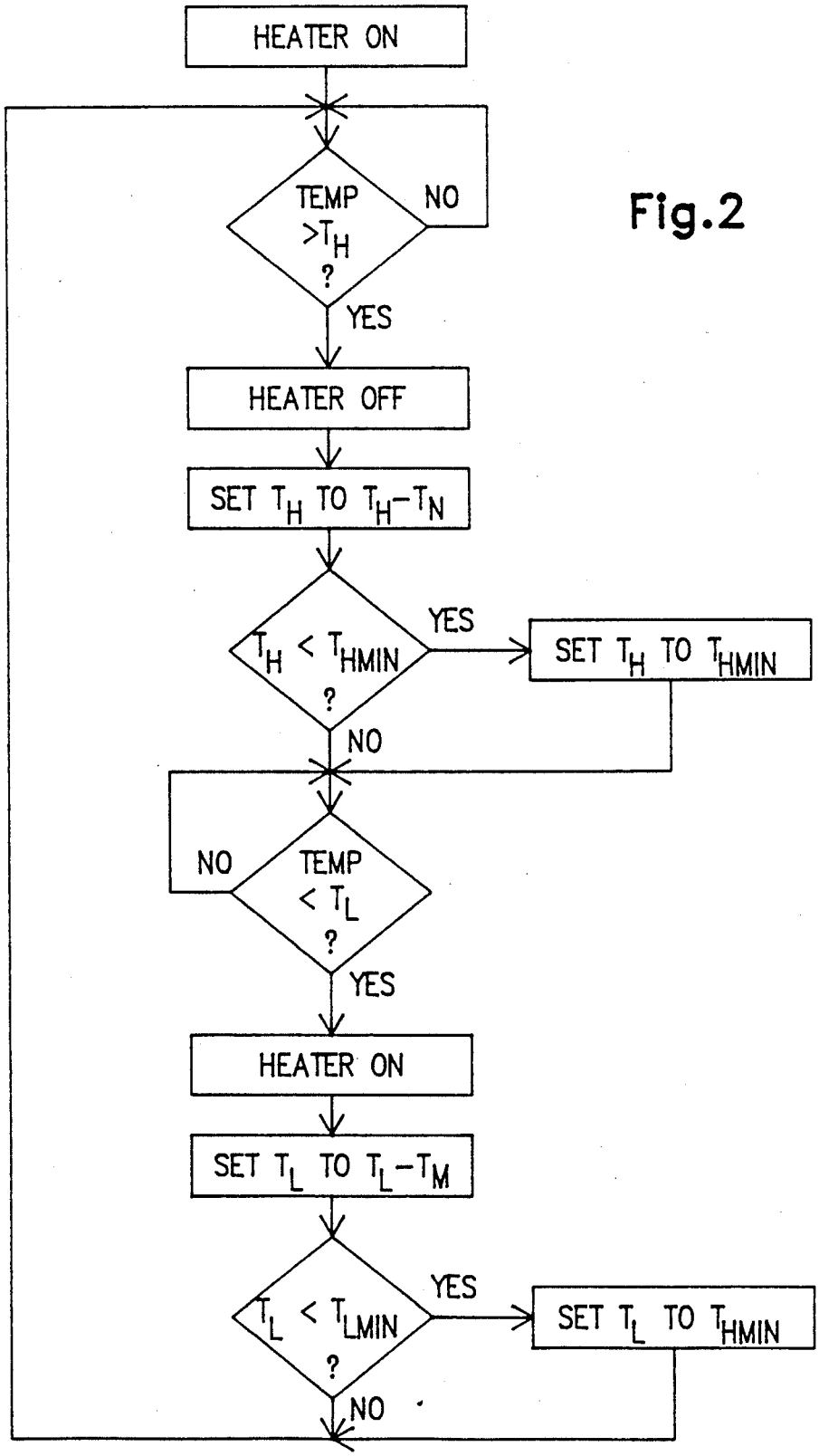
FIG. 2 is a flow chart diagram of a method according to the invention.

FIG. 2 shows a flow chart of the preferred embodiment of a method according to the invention. Initially the heater 12 is activated and the controller 18 compares the measured temperature 16 to an initial value of a high limit temperature $T_H$. This temperature may be for example, 55° C. for cotton or 40° C. for knits, the choice being controlled by the cycle selector 22.

If the high limit temperature $T_H$ has not been reached, the controller 18 continues to monitor the temperature 16. If the temperature 16 exceeds $T_H$, the controller 18 deactivates the heater 12 and sets $T_H$ to the old value less a reduction factor $T_N$. The reduction factor $T_N$ may be, for example, 5° C., but other values could be used, the selection being controlled by the cycle selector 22 according to the fabric being dried.

If the newly calculated value of $T_H$ is less than a minimum high limit temperature $T_{HMIN}$, $T_H$ is set to $T_{HMIN}$. $T_{HIMN}$ may be, for example, 30° C., but other values could be used, the selection being controlled by the cycle selector 22 according to the fabric being dried.

The controller 18 then compares the temperature 16 to an initial value of a low limit temperature $T_L$. This temperature may be, for example, 50° C. for cotton or 35°C. for knits, the choice being controlled by the cycle selector 22.

If the low limit temperature $T_L$ has not been reached, the controller 18 continues to monitor the temperature 16. If the temperature 16 drops below $T_L$, the controller 18 activates the heater 12 and sets $T_L$ to the old value less a reduction factor $T_M$. The reduction value $T_M$ may be, for example, 5° C., but other values could be used, the selection being controlled by the cycle selector 22 according to the fabric being dried.

If the newly calculated value of $T_L$ is less than a minimum low limit temperatue $T_{LMIN}$, $T_L$ is set to $T_{LMIN}$. $T_{LMIN}$ may be, for example, 25° C., but other values could be used, the selection being controlled by the cycle selector 22 according to the fabric being dried.

The controller 18 then starts to compare the temperature 16 to $T_H$ again and continues to repeat the process until interrrupted.

In operation, this results in the temperature 16 oscillating between progressively cooler values of $T_H$ and $T_L$ until $T_H$ and $T_L$ become equal to $T_{H\ HMIN}$ and $T_{LMIN}$, respectively, whereupon the temperature 16 oscillates between a constant $T_H$ and $T_L$.

It has been found that this grandual reduction in $T_H$ and $T_L$ results in an advantageous reduction in load temperature without a proportional increase in drying time. A reduction in load temperature provides more satisfactory results. Once the load temperature reaches the release point for a particular fabric, further time at, or above, the release temperature results in yellowed whites, shrinkage and other cumulative damage, as well as a wrinkled appearance. The present invention minimizes the period of high temperature without a proportional increase in the total drying time.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A method of gradual heat reduction for a clothes dryer having a heater and a dryer exhaust, said method comprising:

providing a series of exhaust temperature measurements;

deactivating the heater if the measurement is greater than a high limit and reducing the high limit by a high limit reduction factor;

preventing said high limit from being reduced below a minimum high limit;

activating the heater if the exhaust temperature is less than a low limit and reducing the low limit by a low limit reduction factor; and preventing said low limit from being reduced below a minimum low limit, whereby a series of said high and low limits are utilized to decrease the temperature of a load in the dryer without a proportional increase in the time required to dry the load.

2. A method according to claim 1, wherein said high limit reduction factor and low limit reduction factor are equal.

3. A method according to claim 1, further comprising:

providing a plurality of sets of predetermined values for an initial high limit, the high limit reduction factor, the minimum high limit, an initial low limit, the low limit reduction factor, and the minimum low limit, each said set being adapted for a particular fabric; and selecting a particular set of values, whereby the gradual heat reduction appropriate for a specific fabric is provided.

4. An apparatus for gradual heat reduction in a clothes dryer having a heater and a dryer exhaust, said apparatus comprising:

means for providing a series of exhaust temperature measurements;

means for deactivating the heater if the meeasurement is greater then a high limit and reducing the high limit by a high limit reduction factor;

means for preventing said high limit from being reduced below a minimum high limit;

means for activating the heater if the exhaust temperature is less than a low limit and reducing the low limit by a low limit reduction factor; and means for preventing said low limit from being reduced below a minimum low limit, whereby a series of said high and low limits are utilized to decrease the temperature of a load in the dryer without a proportional increase in the time required to dry the load.

5. An apparatus according to claim 4, wherein said high limit reduction factor and low limit reduction factor are equal.

6. An apparatus according to claim 4, further comprising:

a plurality of sets of predetermined values for an initial high limit, the high limit reduction factor, the minimum high limit, an initial low limit, the low limit reduction factor, and the minimum low limit, each said set being adapted for a particular fabric; and means for selecting a particular set of values, whereby the gradual heat reduction appropriate for a specific fabric is provided.

* * * * *

UNITED STATES PATENT AND TRADEMARK OFFICE

CERTIFICATE OF CORRECTION

PATENT NO. : 4,991,313

DATED : February 12, 1991

INVENTOR(S) : Dan F. Joslin

It is certified that error appears in the above-identified patent and that said Letters Patent is hereby corrected as shown below:

Column 2, line 15, delete "$T_{HIMN}$" and insert --$T_{HMIN}$--;

line 41, delete "interrrupted" and insert --interrupted-- and line 47, delete "grandual" and insert --gradual--.

Column 4, Claim 4, line 6, delete "meeasure-" and insert --measure- --;

line 7, delete "then" and inset --than--.

Signed and Sealed this

Fourteenth Day of July, 1992

*Attest:*

DOUGLAS B. COMER

*Attesting Officer*

*Acting Commissioner of Patents and Trademarks*